US007273266B2

(12) United States Patent
Krawczyk et al.

(10) Patent No.: US 7,273,266 B2
(45) Date of Patent: Sep. 25, 2007

(54) MICRO-FLUID EJECTION ASSEMBLIES

(75) Inventors: John William Krawczyk, Richmond, KY (US); Andrew Lee McNees, Lexington, KY (US); James Michael Mrvos, Lexington, KY (US); Carl Edmond Sullivan, Stamping Ground, KY (US)

(73) Assignee: Lexmark International, Inc., Lexington, KY (US)

( * ) Notice: Subject to any disclaimer, the term of this patent is extended or adjusted under 35 U.S.C. 154(b) by 237 days.

(21) Appl. No.: 10/823,939

(22) Filed: Apr. 14, 2004

(65) Prior Publication Data

US 2005/0231557 A1 Oct. 20, 2005

(51) Int. Cl.
*B41J 2/05* (2006.01)

(52) U.S. Cl. ..... 347/56; 430/230; 216/27

(58) Field of Classification Search ..... 347/56; 430/230; 216/27

See application file for complete search history.

(56) References Cited

U.S. PATENT DOCUMENTS

| | | | | |
|---|---|---|---|---|
| 3,958,255 | A | 5/1976 | Chiou et al. | |
| 5,087,591 | A * | 2/1992 | Teng | 438/637 |
| 5,143,577 | A * | 9/1992 | Haas et al. | 216/24 |
| 5,320,932 | A | 6/1994 | Haraguchi et al. | |
| 5,350,491 | A | 9/1994 | Fulford, Jr. et al. | |
| 5,350,492 | A | 9/1994 | Hall et al. | |
| 5,362,356 | A | 11/1994 | Schoenborn | |
| 5,482,882 | A * | 1/1996 | Lur et al. | 438/396 |
| 5,861,902 | A * | 1/1999 | Beerling | 347/63 |
| 6,183,067 | B1 * | 2/2001 | Matta | 347/65 |
| 6,204,182 | B1 | 3/2001 | Truninger et al. | |
| 6,207,491 | B1 | 3/2001 | Chu et al. | |
| 6,284,606 | B1 | 9/2001 | Samudra et al. | |
| 6,294,474 | B1 | 9/2001 | Tzeng et al. | |
| 6,402,301 | B1 | 6/2002 | Powers et al. | |
| 6,595,627 | B2 | 7/2003 | Min et al. | |
| 6,620,732 | B1 | 9/2003 | Schuegraf | |
| 2002/0113846 | A1 * | 8/2002 | Wang et al. | 347/68 |
| 2002/0135640 | A1 * | 9/2002 | Chen et al. | 347/63 |
| 2004/0077163 | A1 | 4/2004 | Chang et al. | |

FOREIGN PATENT DOCUMENTS

| | | |
|---|---|---|
| JP | 2002-046266 | 2/2002 |
| TW | 0405204 | 9/2000 |
| TW | 0452872 | 9/2001 |

* cited by examiner

*Primary Examiner*—Manish S. Shah
*Assistant Examiner*—Laura E. Martin
(74) *Attorney, Agent, or Firm*—Luedeka, Neely & Graham, PC

(57) ABSTRACT

A micro-fluid ejection assembly including a silicon substrate having accurately formed fluid paths therein. The fluid paths are formed by a deep reactive ion etching process conducted on a substrate having a surface characteristic before etching selected from the group consisting of a dielectric layer thickness of no more than about 5000 Angstroms, and a substantially dielectric material free pitted surface wherein a root mean square depth of surface pitting is less than about 500 Angstroms and a maximum surface pitting depth is no more than about 2500 Angstroms. Fluid paths in such substrates having improved flow characteristics for more reliable fluid ejection operations.

19 Claims, 5 Drawing Sheets

MICRO-FLUID EJECTION ASSEMBLIES

FIELD OF THE INVENTION

The disclosure relates to micro-fluid ejection assemblies and, in particular, to ejection assemblies having accurately formed flow features etched therein.

BACKGROUND OF THE INVENTION

Micro-fluid ejection assemblies typically include a silicon substrate material that contains fluid openings, trenches, and/or depressions formed therein. The fluid openings, trenches, and/or depressions are collectively referred to herein as "flow features." Such flow features may be formed by a wide variety of micromachining techniques including sand blasting, wet chemical etching and reactive ion etching. As the devices become smaller, such as for ink jet printhead applications, micromachining of the substrates becomes a more critical operation. Not all micromachining techniques are reliable enough to produce accurately placed flow features having similar flow characteristics in the substrates. Accordingly, the micro-fluid ejection assembly art is constantly searching for improved micro-fluid ejection assemblies that can be produced in high yield at a minimum cost.

SUMMARY OF THE INVENTION

With regard to the above, there is provided a micro-fluid ejection assembly including a silicon substrate having accurately formed fluid paths therein. The fluid paths are formed by a deep reactive ion etching process conducted on a substrate having a surface characteristic before etching selected from the group consisting of a dielectric layer thickness of no more than about 5000 Angstroms, and a substantially dielectric material free pitted surface wherein a root mean square depth of surface pitting is less than about 500 Angstroms and a maximum surface pitting depth is no more than about 2500 Angstroms.

In another embodiment, a substrate for an ink jet printer heater chip having accurately formed fluid openings therein is provided. The fluid openings are formed by a deep reactive ion etching process conducted on the substrate. The substrate includes a silicon substrate having a surface characteristic before etching selected from the group consisting of an oxide layer thickness ranging from about 0 to no more than about 5000 Angstroms, and a substantially oxide free pitted surface wherein a root mean square depth of surface pitting is less than about 500 Angstroms and a maximum surface pitting depth is no more than about 2500 Angstroms.

In yet another embodiment, there is provided a micro-fluid ejection assembly comprising a silicon substrate having accurately formed reactive ion etched fluid flow features therein. The etched fluid flow features are formed by a reactive ion etching process conducted on a substrate having a surface characteristic before etching selected from the group consisting of an oxide layer thickness of no more than about 5000 Angstroms, and a substantially oxide free pitted surface wherein a root mean square depth of surface pitting is less than about 500 Angstroms and a maximum surface pitting depth is no more than about 2500 Angstroms.

An advantage of embodiments described herein is that an etched substrate may be produced by deep reactive ion etching to provide accurately produced parts which meet or exceed critical tolerances for the parts. The parts may include a wide variety of flow features including, but not limited to, etched fluid openings or etched recesses for fluids such as inks. For proposes of this invention, "dielectric layer" and "dielectric material" include, but are not limited to, silicon oxides, silicon nitrides, silicon carbides, phosphorus spin on glass (PSOG) and boron doped phosphorus spin on glass (BPSOG).

BRIEF DESCRIPTION OF THE DRAWINGS

Further advantages of the invention will become apparent by reference to the detailed description of preferred embodiments when considered in conjunction with the following drawings, in which like reference numbers denote like elements throughout the several views, and wherein.

DETAILED DESCRIPTION OF THE PREFERRED EMBODIMENTS

Figure 1:
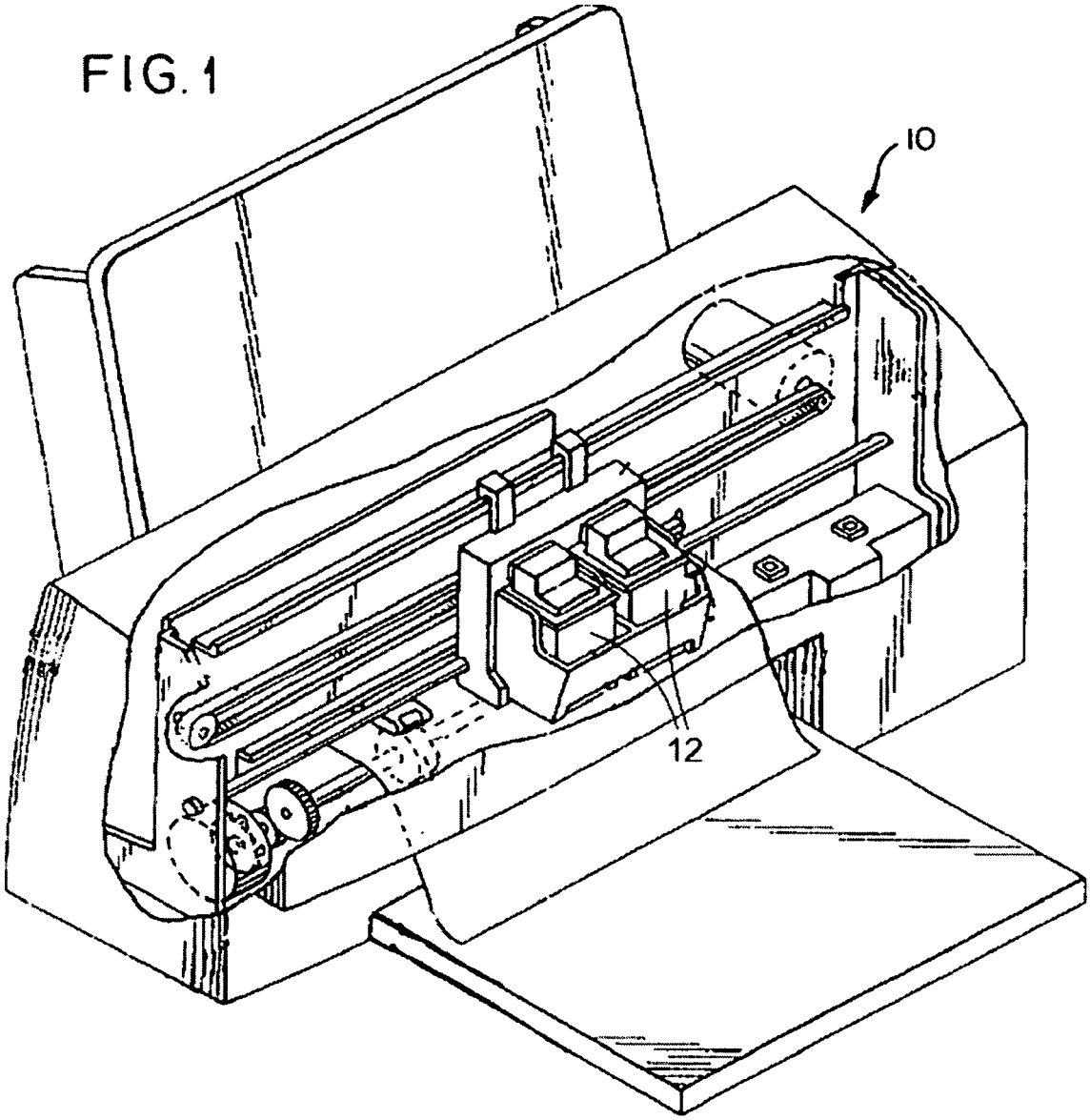
FIG. 1 is a perspective view, not to scale, of a fluid ejection device.

Embodiments as described herein are particularly suitable for micro-fluid ejection assemblies used in fluid ejection devices. An exemplary fluid ejection device 10 is illustrated in FIG. 1. In a preferred embodiment, the fluid ejection device 10 is an ink jet printer containing one or more ink jet printer cartridges 12.

Figure 2:
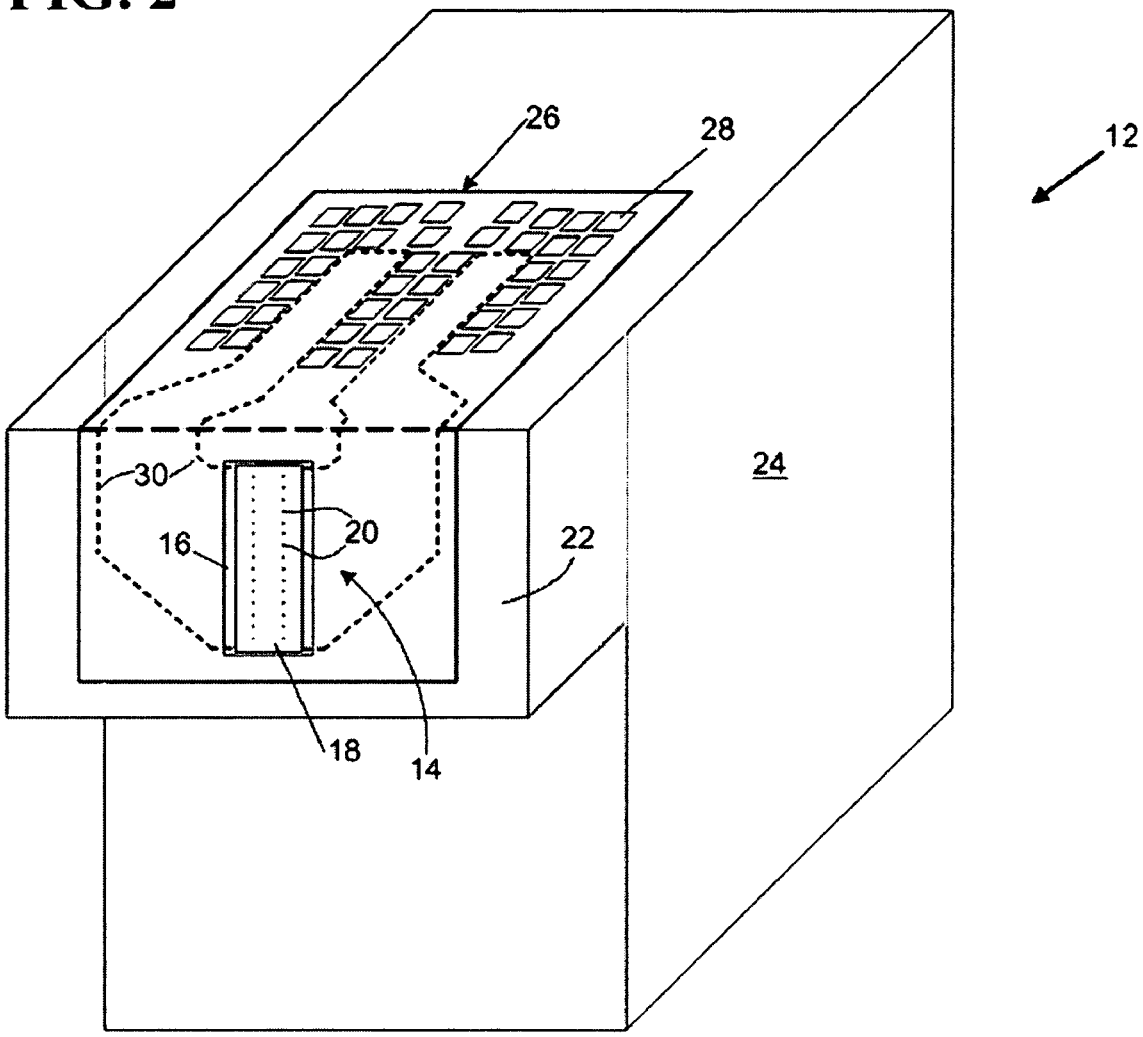
FIG. 2 is a perspective view, not to scale, of a fluid cartridge for a fluid ejection device.

An exemplary ink jet printer cartridge 12 is illustrated in FIG. 2. The cartridge 12 includes a printhead 14, also referred to herein as "a micro-fluid ejection assembly." As described in more detail below, the printhead 14 includes a heater chip 16 having a nozzle plate 18 containing nozzle holes 20 attached thereto. The printhead 14 is attached to a printhead portion 22 of the cartridge 12. A main body 24 of the cartridge 12 includes a fluid reservoir for supply of a fluid such as ink to the printhead 14. A flexible circuit or tape automated bonding (TAB) circuit 26 containing electrical contacts 28 for connection to the printer 10 is attached to the main body 24 of the cartridge 12. Electrical tracing 30 from the electrical contacts 28 are attached to the heater chip 16 to provide activation of electrical devices on the heater chip 16 on demand from the printer 10 to which the cartridge 12 is attached. The invention however, is not limited to ink cartridges 12 as described above as the micro-fluid ejection assemblies 14 described herein may be used in a wide variety of fluid ejection devices, including but not limited to, ink jet printers, micro-fluid coolers, pharmaceutical delivery systems, and the like.

Figure 3:
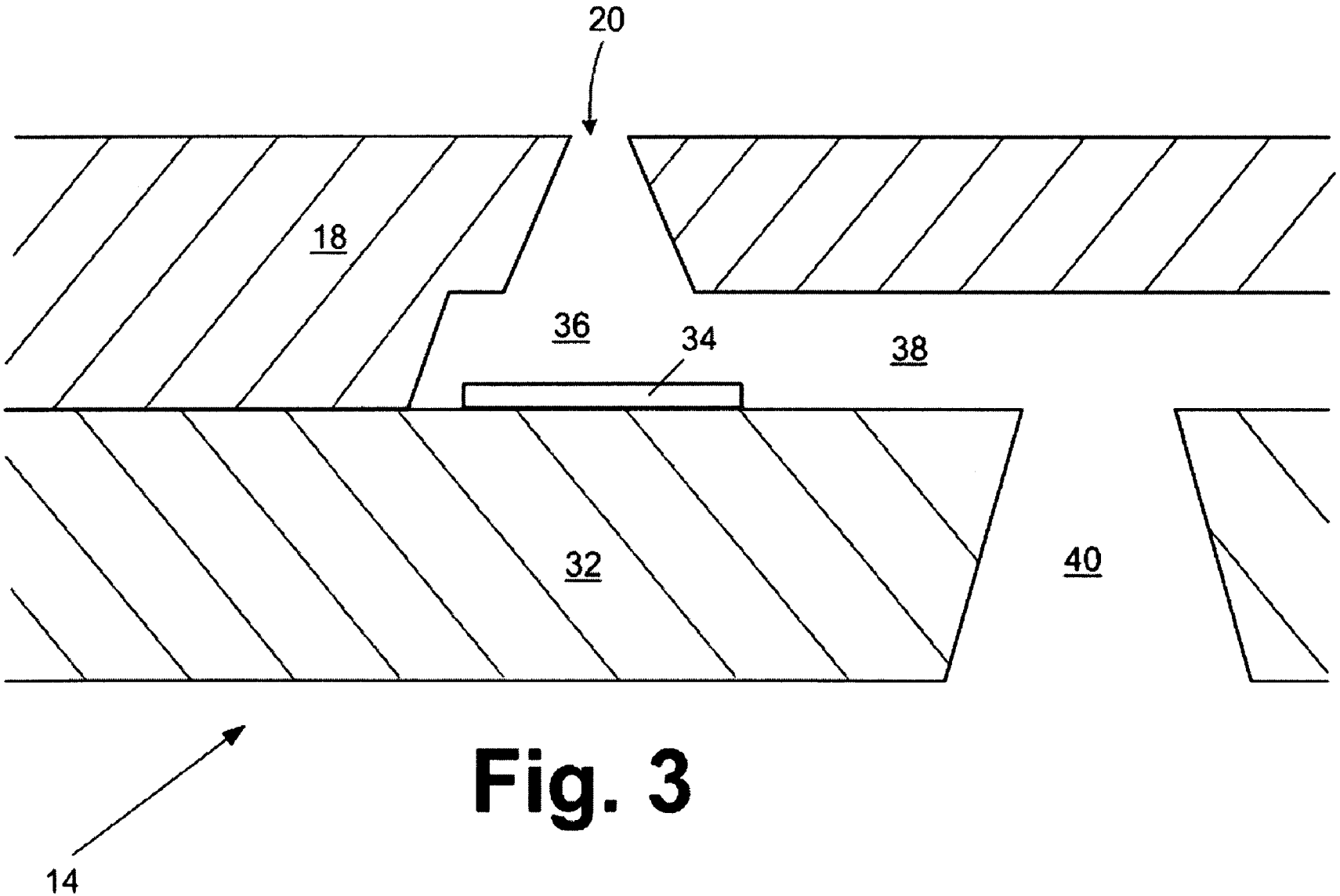
FIGS. 3 and 4 are cross-sectional views, not to scale, of portions of a micro-fluid ejection assembly.

A small, cross-sectional, simplified view of a micro-fluid ejection assembly 14 is illustrated in FIG. 3. The micro-fluid ejection assembly 14 includes a semiconductor chip 32 containing a fluid ejection generator provided as by a heater resistor 34 and the nozzle plate 18 attached to the chip 32. The nozzle plate 18 contains the nozzle holes 20 and is preferably made from a fluid resistant polymer such as polyimide. Fluid is provided adjacent the heater resistor 34 in a fluid chamber 36 from a fluid channel 38 that connects through an opening or via 40 in the chip with the fluid reservoir in the main body 24 of the cartridge 12.

Figure 4:
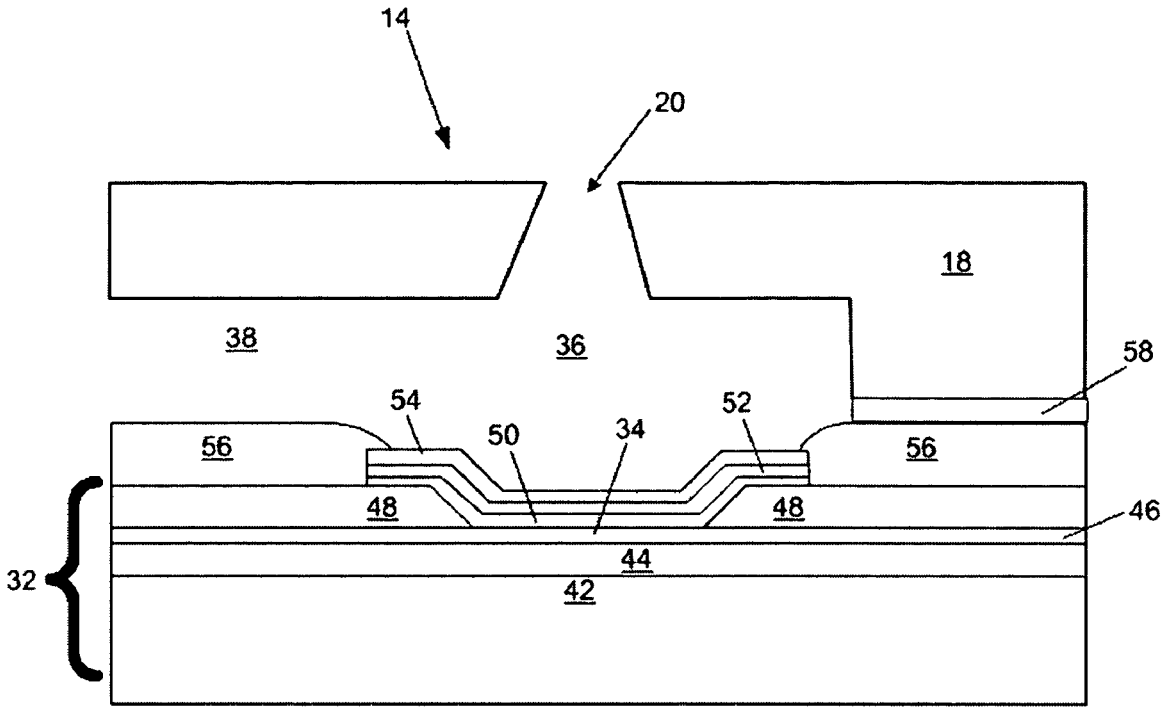

In order to provide electrical impulses to the heater resistor 34, the semiconductor chip 32 undergoes a number of thin film deposition and etching steps to define multiple functional layers on a semiconductor substrate such as silicon 42 (FIG. 4). Conventional microelectronic fabrication processes such as physical vapor deposition (PVD), chemical vapor deposition (CVD), or sputtering may be used to provide the various layers on the semiconductor substrate 42. As illustrated in FIG. 4, the chip 32 includes a substrate layer 42 of silicon, an insulating or first dielectric layer 44, a resistor layer 46, a first conductive layer 48, and one or more protective layers 50, 52, and 54. A second dielectric layer 56 is provided to insulate between the first conductive layer 48 and a second conductive layer 58. The first and second conductive layers 48 and 58 provide anode and cathode connections to the heater resistor 34.

The first dielectric layer 44 is preferably a field oxide layer of silicon dioxide having a thickness under the resistor layer 46 of about 10,000 Angstroms. However, the first dielectric layer 44 may also be provided by other materials, including, but not limited to, silicon carbides, silicon nitrides, phosphorus spin on glass, boron doped phosphorus spin on glass, and the like. The resistor layer 46 may be selected from a wide variety of metals or alloys having resistive properties. The first and second conductive layers 48 and 58 are typically metal conductive layers. The protective layers 50, 52, and 54 include passivation materials such as SiN and SiC and tantalum.

In order to define the various insulating, resistive, and conductive layers on the chip 32, multiple etching steps are conducted. Until now, there has been no control of the amount of oxide layer 44 remaining in the opening, via, or trench 40 location for the chip 32. As a result, dielectric material thicknesses, such as oxide layer thicknesses, in the via 40 location, before etching the vias may range from thicknesses of substantially greater than about 5000 Angstroms, to pitted silicon 32 surfaces devoid of dielectric materials. Such a variation in dielectric layer thickness, or over removal of the dielectric material in the via locations has a detrimental effect on the via formation process.

Thin films substances made of different materials exhibit markedly different etch rates when exposed to reactive ion etching. Additionally, reactive ion etching of such substances may occur along decidedly different mechanistic pathways. For example, etch rates of silicon dioxide are typically two orders of magnitude lower than pure silicon for equivalent plasma etching operating conditions. Typically, silicon dioxide etches about 100 to 150 times slower than pure silicon. Accordingly, an oxide may be used as a masking layer or etch stop layer when etching a silicon substrate. For purposes of the disclosure, references to "silicon oxide" are intended to include, silicon mono-oxide, silicon dioxide and $SiO_x$ wherein x ranges from about 1 to about 4.

Figure 5:
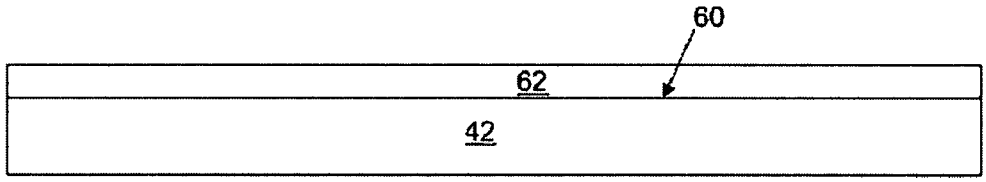
FIGS. 5-9 are cross-sectional views, not to scale, of silicon substrates having trench or via locations therein.
Figure 6:
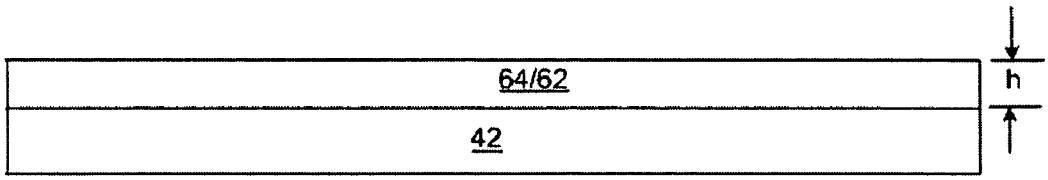

With reference now to FIGS. 5 and 6, when a semiconductor substrate surface such as surface 60 of the silicon substrate 42 or wafer is exposed to air, a silicon oxide layer 62 forms on the surface 60 of the silicon substrate 42 as shown in FIG. 5. Typically, such silicon oxide layer 62 is no more than about 200 Angstroms thick. When a silicon substrate 42 is used as a thin film layer component of the micro-fluid ejection assembly 14 as described above, electrical components are formed on the substrate by depositing additional layers thereon. In order for the device to work properly, an insulating first dielectric layer 64 of sufficient thickness is preferably formed on the silicon substrate surface 60 before depositing the resistive layer 46, metal layers 48 and 58, protective layers 50, 52, and 54, and second dielectric layer 56 described above. The dielectric layer 64 may include the oxide layer 62 (FIG. 2) and typically has a thickness or height h that provides sufficient insulating and/or dielectric characteristics for operation of the micro-fluid ejection device. A suitable height preferably ranges from about 8,000 to about 12,000 Angstroms.

Despite its beneficial characteristics as an insulating or dielectric material, it has been observed that the presence of certain dielectric materials, such dielectric layer and oxide 64/62, in reactive ion etch locations such as location 66 for a fluid opening or via 40 in the substrate 42 (FIG. 7) can seriously affect the quality of the etched substrate 42 resulting in inaccurate and unrepeatable geometries. The presence of relatively thin dielectric layer/oxide 64/62 in the etch areas 66 can significantly increase cycle time for etching the substrate 42, because the etch rate of certain dielectric materials is significantly longer than the etch rate of pure silicon. Similarly, variations in either dielectric layer/oxide 64/62 thickness or the process by which the dielectric material is removed may result in radically non-uniform etches and as well as pitting of the substrate surface 60 as shown in FIG. 8.

Without being bound by theory, and for the purposes of example only, the etch rate mechanism is believed to correspond to the following equation, assuming a linear etch rate for simplicity:

$$z=r_{silicon}*(t-h/r_{oxide})+h,$$

where $t \geqq h/r_{oxide}$ and where z is the etch depth of the trench, $r_{silicon}$ is the etch rate of silicon, $r_{oxide}$ is the etch rate of silicon dioxide, t is the etch time and h is the height of oxide in the trench. Thus, based on this, as the height or thickness h of dielectric layer/oxide 64/62 in the etch area 66 increases, the etch depth for a given period of time t decreases.

For example, for an oxide thickness h of 0.2 microns, and assuming a linear etch rate of silicon of ten microns per minute and for silicon oxide, an etch rate of 0.07 microns per minute, the etch depth z would be about 21.6 microns after five minutes. If the dielectric layer/oxide thickness h is 0.02 microns, the etch depth would be about 47.3 microns after five minutes. In other words, the etch rate for a substrate 42 containing an dielectric layer/oxide 64/62 having a thickness of 0.02 microns is more than twice the etch rate of a substrate 42 containing a dielectric layer/oxide 64/62 thickness of 0.2 microns in the etching location. Accordingly, an amount of dielectric layer/oxide 64/62 having a thickness of about 2000 Angstroms can significantly increase etching time. Furthermore, the presence of dielectric layer/oxide 64/62 in the active etch regions 66 may cause etching chamber contamination leading to a decrease in operation time between chamber cleanings thereby further increasing cycle etch times. One of the advantages of using a reactive ion etching process, such as deep reactive ion etching (DRIE) as opposed to other techniques such as grit-blasting, is the ability to etch a wafer's worth of substrates 42 quickly and simultaneously. In a DRIE process, a photoresist material 70 is applied to the substrate 42 to define the location 66 of the openings or trenches 40 in the substrate 42. If, on the other hand, cycle time is increased significantly, the economic advantages of DRIE may be diminished.

While substantially complete removal of dielectric layer/oxide 64/62 from the etch locations 66 on the surface 60 of the silicon substrate 42 would be the most desirable condition for reaction ion etching, as is often the case in technical endeavors, solutions to initial problems are often themselves wrought with undesirable consequences. For example, dielectric layer removal when accomplished through plasma etching often leads to formation of one or more pits 68 on the silicon surface 60 as shown in FIG. 8. At first, this problem appears to be a simple residence time issue, but further analysis reveals that often plasma etches are characteristically non-uniform with particular substrates containing both under etched regions (regions where oxide persists) and over etched region (pits 68). The under etched regions are problematic for the previously documented reasons that the remaining dielectric layer increases the etch cycle time. The over etched areas, although they, presumably, are dielectric layer free, are now populated with pits 68. The pits 68, at certain levels of severity, can result in phenomena as drastic as the formation of horizontal or vertical needle-like projections, known generally in the art as "grassing." At best, when present prior to DRIE etch, pits 68 create unintended avenues for etching species. Etching of pitted substrates results in rough inexact etches which may have deleterious consequences for adjacent thin film and or photo-resist layers. The embodiments disclosed herein provide tolerances and limits on the surface characteristics of a silicon substrate 42 to provide improved etched products and etch rates.

Accordingly, silicon substrate 42 having a first dielectric layer thickness of no more than about 5000 Angstroms, at least in the via locations 66, can provide reasonable etching cycle times for DRIE etching of the vias 40. Accordingly, a preferred substrate 42 has an dielectric layer thickness ranging from about 0 to about 5000 Angstroms, most preferably from about 200 to about 5000 Angstroms. Likewise, the substrate 42 preferably has pitted surface characteristics in the via locations 66 that have a root mean squared pitting depth of less than about 500 Angstroms and a maximum pit depth of about 2500 Angstroms. Substrates 42 with such dielectric layer tolerances in the via or trench 40 areas exhibit improved etching rates as well as substantially uniform surface characteristics after etching.

Figure 7:
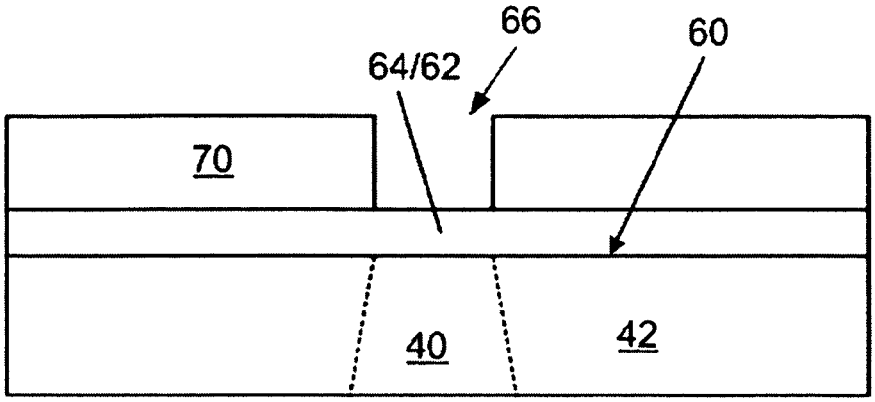
Figure 8:
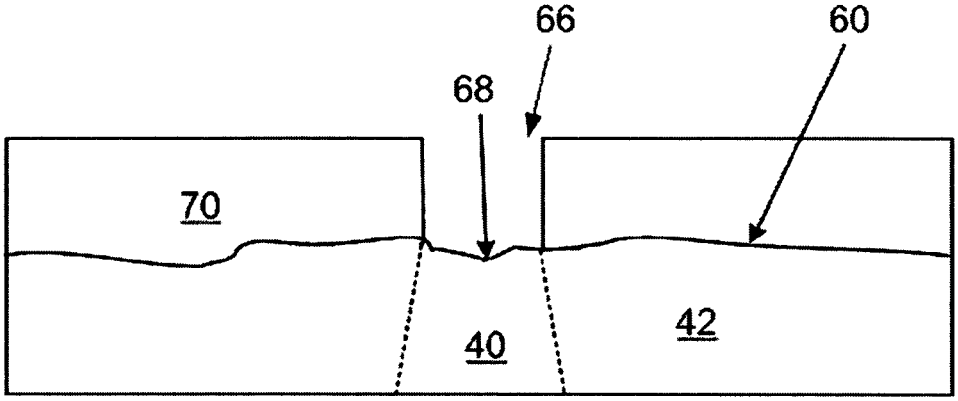
Figure 9:
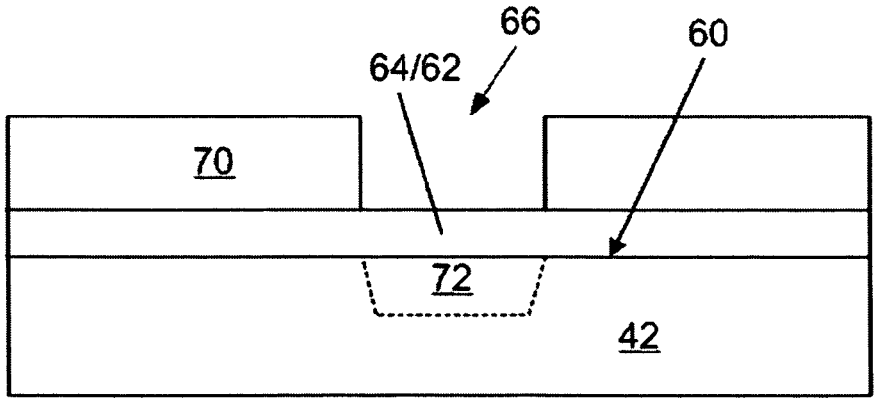

As shown in FIGS. 7 and 8, the vias 40, described above, extend through the thickness of the substrate 42. However, it will be appreciated that the embodiments described herein are also applicable to the formation of trenches or recessed areas 72 in a substrate 42 as shown in FIG. 9.

While specific embodiments of the invention have been described with particularity herein, it will be appreciated that the invention is applicable to modifications and additions by those skilled in the art within the spirit and scope of the appended claims.

What is claimed is:

1. A micro-fluid ejection assembly, comprising a silicon substrate having accurately formed fluid paths therein, the fluid paths being formed by a deep reactive ion etching process conducted on a substrate having a surface characteristic before etching selected from the group consisting of a dielectric layer thickness of no more than about 5000 Angstroms, and a substantially dielectric material free pitted surface wherein a root mean square depth of surface pitting is less than about 500 Angstroms and a maximum surface pitting depth is no more than about 2500 Angstroms.

2. The micro-fluid ejection assembly of claim 1 wherein the surface characteristic comprises an oxide thickness of no more than about 5000 Angstroms.

3. The micro-fluid ejection assembly of claim 2 wherein the oxide thickness ranges from about 200 to about 5000 Angstroms.

4. The micro-fluid ejection assembly of claim 1 wherein the surface characteristic comprises a substantially oxide free pitted surface wherein a root mean square depth of surface pitting is less than about 500 Angstroms and a maximum surface pitting depth is no more than about 2500 Angstroms.

5. The micro-fluid ejection assembly of claim 1 wherein the surface characteristic is adjacent to a fluid openings area of the substrate.

6. The micro-fluid ejection assembly of claim 1 wherein the dielectric layer is selected from the group consisting of silicon oxides, silicon nitrides, silicon carbides, phosphorus spin on glass, and boron doped phosphorus spin on glass.

7. An ink jet printer containing the micro-fluid ejection assembly of claim 1.

8. A substrate for an ink jet printer heater chip having accurately formed fluid openings therein, the fluid openings being formed by a deep reactive ion etching process conducted on the substrate wherein the substrate comprises a silicon substrate having a surface characteristic before etching selected from the group consisting of an oxide layer thickness ranging from about 0 to no more than about 5000 Angstroms, and a substantially oxide free pitted surface wherein a root mean square depth of surface pitting is less than about 500 Angstroms and a maximum surface pitting depth is no more than about 2500 Angstroms.

9. The substrate of claim 8 wherein the surface characteristic comprises an oxide thickness of no more than about 5000 Angstroms.

10. The substrate of claim 9 wherein the oxide thickness ranges from about 200 to about 5000 Angstroms.

11. The substrate of claim 8 wherein the surface characteristic comprises a substantially oxide free pitted surface wherein a root mean square depth of surface pitting is less than about 500 Angstroms and a maximum surface pitting depth is no more than about 2500 Angstroms.

12. The substrate of claim 8 wherein the surface characteristic is adjacent to a fluid openings area of the substrate.

13. An ink jet printer containing the substrate of claim 8.

14. A micro-fluid ejection assembly comprising a silicon substrate having accurately formed reactive ion etched fluid flow features therein, the etched fluid flow features being formed by a reactive ion etching process conducted on a substrate having a surface characteristic before etching selected from the group consisting of an oxide layer thickness of no more than about 5000 Angstroms, and a substantially oxide free pitted surface wherein a root mean square depth of surface pitting is less than about 500 Angstroms and a maximum surface pitting depth is no more than about 2500 Angstroms.

15. The micro-fluid ejection assembly of claim 14 wherein the surface characteristic comprises an oxide thickness of no more than about 5000 Angstroms.

16. The micro-fluid ejection assembly of claim 15 wherein the oxide thickness ranges from about 200 to about 5000 Angstroms.

17. The micro-fluid ejection assembly of claim 14 wherein the surface characteristic comprises a substantially oxide free pitted surface wherein a root mean square depth of surface pitting is less than about 500 Angstroms and a maximum surface pitting depth is no more than about 2500 Angstroms.

18. The micro-fluid ejection assembly of claim 14 wherein the surface characteristic is adjacent to a fluid openings area of the substrate.

19. An ink jet printer containing the micro-fluid ejection assembly of claim 14.

* * * * *